US008999084B2

(12) United States Patent
Fushiwaki et al.

(10) Patent No.: US 8,999,084 B2
(45) Date of Patent: Apr. 7, 2015

(54) METHOD FOR MANUFACTURING A GALVANIZED STEEL SHEET

(75) Inventors: Yusuke Fushiwaki, Hiroshima (JP); Yoshiharu Sugimoto, Chiba (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 13/131,656

(22) PCT Filed: Nov. 25, 2009

(86) PCT No.: PCT/JP2009/070205

§ 371 (c)(1),
(2), (4) Date: Jun. 24, 2011

(87) PCT Pub. No.: WO2010/061954

PCT Pub. Date: Jun. 3, 2010

(65) Prior Publication Data

US 2011/0253263 A1 Oct. 20, 2011

(30) Foreign Application Priority Data

Nov. 27, 2008 (JP) ..... 2008-301920

(51) Int. Cl.

| | |
|---|---|
| ***C23C 2/06*** | (2006.01) |
| ***C23C 2/02*** | (2006.01) |
| ***C21D 6/00*** | (2006.01) |
| ***C21D 9/46*** | (2006.01) |
| ***C22C 38/02*** | (2006.01) |
| ***C22C 38/04*** | (2006.01) |
| ***C22C 38/06*** | (2006.01) |
| ***C23C 2/28*** | (2006.01) |

(52) U.S. Cl.

CPC . *C23C 2/02* (2013.01); *C21D 6/005* (2013.01); *C21D 6/008* (2013.01); *C21D 9/46* (2013.01); *C22C 38/02* (2013.01); *C22C 38/04* (2013.01); *C22C 38/06* (2013.01); *C23C 2/06* (2013.01); *C23C 2/28* (2013.01)

(58) Field of Classification Search

USPC ..... 148/533; 428/653

See application file for complete search history.

(56) References Cited

U.S. PATENT DOCUMENTS

| | | | | |
|---|---|---|---|---|
| 7,074,497 | B2 | 7/2006 | Suzuki et al. | |
| 7,695,826 | B2 | 4/2010 | Tanaka et al. | |
| 2004/0234807 | A1 | 11/2004 | Suzuki et al. | |
| 2010/0304183 | A1 * | 12/2010 | Honda et al. | 428/659 |

FOREIGN PATENT DOCUMENTS

| | | | |
|---|---|---|---|
| EP | 1482066 | | 12/2004 |
| EP | 1634975 | | 3/2006 |
| EP | 1980638 | | 7/2006 |
| EP | 1806422 | A1 * | 7/2007 |
| JP | 8-246121 | | 9/1996 |
| JP | 10-259466 | | 9/1998 |
| JP | 2006-097094 | | 4/2006 |
| JP | 2006233333 | | 9/2006 |
| WO | WO 03/074751 | | 9/2003 |

OTHER PUBLICATIONS

S. Lampman, Energy-Efficient Heat treating Furnace Design and Operation, Heat Treting, vol. 4, ASM Handbook, ASM International, 1991, 1-7.*

International Search Report, PCT/JP2009/070205, Dec. 28, 2009.

Extended European search report, dated Jul. 7, 2014, in corresponding European Patent Application No. 09829192.5.

* cited by examiner

*Primary Examiner* — Deborah Yee

(74) *Attorney, Agent, or Firm* — Young & Thompson

(57) ABSTRACT

A galvanized steel sheet includes a zinc plating layer which is disposed on a steel sheet containing 0.01% to 0.15% C, 0.001% to 2.0% Si, 0.1% to 3.0% Mn, 0.001% to 1.0% Al, 0.005% to 0.060% P, and 0.01% or less S on a mass basis, the remainder being Fe and unavoidable impurities, and which has a mass per unit area 20 g/m$^2$ to 120 g/m$^2$. An oxide of at least one selected from the group consisting of Fe, Si, Mn, Al, and P is present in a surface portion of the steel sheet that lies directly under the zinc plating layer and that extends up to 100 μm from the surface of a base steel sheet. The amount of the oxide per unit area is 0.05 g/m$^2$ or less in total. The steel sheet has excellent corrosion resistance, anti-powdering property during heavy machining, and strength.

10 Claims, No Drawings

METHOD FOR MANUFACTURING A GALVANIZED STEEL SHEET

TECHNICAL FIELD

The present invention relates to a galvanized steel sheet which includes a base member that is a steel sheet containing Si and Mn and which has excellent corrosion resistance, excellent workability, and high strength and also relates to a method for manufacturing the same.

BACKGROUND ART

In recent years, surface-treated steel sheets made by imparting rust resistance to base steel sheets, particularly galvanized steel sheet and galvannealed steel sheets which can be manufactured at low cost and which have excellent rust resistance, have been used in fields such as automobiles, home appliances, and building materials. In view of the improvement of automotive fuel efficiency and the improvement of automotive crash safety, there are increasing demands for lightweight high-strength automobile bodies using automobile body materials having high strength and a reduced thickness. Therefore, high-strength steel sheets are increasingly used for automobiles.

In general, galvanized steel sheets are manufactured in such a manner that thin steel sheets which are prepared by hot-rolling and cold-rolling slabs and which are used as base members are subjected to recrystallization annealing and galvanizing in a continuous galvanizing line (hereinafter also referred to as CGL) including an annealing furnace. Galvannealed steel sheets are manufactured in such a manner that the thin steel sheets are further subjected to alloying subsequently to galvanizing.

Examples of the type of the annealing furnace of the CGL include a DFF (direct fired furnace) type, a NOF (non-oxidizing furnace) type, and an all-radiant tube type. In recent years, CGLs including all-radiant tube-type furnaces have been increasingly constructed because the CGLs are readily operated and are capable of manufacturing high-quality plated steel sheets at low cost due to rarely occurring pick-up. Unlike DFFs (direct fired furnaces) and NOFs (non-oxidizing furnaces), the all-radiant tube-type furnaces have no oxidizing step just before annealing and therefore are disadvantageous in ensuring the platability of steel sheets containing oxidizable elements such as Si and Mn.

PTLs 1 and 2 disclose a method for manufacturing a hot-dipped steel sheet including a base member that is a high-strength steel sheet containing a large amount of Si and Mn. In the method, the heating temperature in a reducing furnace is determined by a formula relating the partial pressure of steam and the dew point is increased such that a surface layer of the base member is internally oxidized. The presence of internal oxides is likely to cause cracking during machining, thereby causing a reduction in anti-powdering property. A reduction in corrosion resistance is also caused.

PTL 3 discloses a technique for improving coating appearance in such a manner that not only the concentrations of $H_2O$ and $O_2$, which act as oxidizing gases, but also the concentration of $CO_2$ are determined such that a surface layer of a base member just before being plated is internally oxidized and is inhibited from being externally oxidized. In the technique disclosed in PTL 3 as well as PTLs 1 and 2, the presence of internal oxides is likely to cause cracking during machining, thereby causing a reduction in anti-powdering property. A reduction in corrosion resistance is also caused. Furthermore, there is a concern that $CO_2$ causes problems such as furnace contamination and changes in mechanical properties due to the carburization of steel sheets.

Recently, high-strength galvanized steel sheets and high-strength galvannealed steel sheets are increasingly used for parts difficult to machine; hence, anti-powdering property during heavy machining becomes important. In particular, in the case of bending a plated steel sheet to more than 90 degrees such that the plated steel sheet forms an acute angle or in the case of machining the plated steel sheet by impact, a coating on a machined portion thereof needs to be inhibited from being peeled off.

In order to satisfy such a property, it is necessary to achieve a desired steel microstructure by adding a large amount of Si to steel and it is also necessary to highly control the microstructure and texture of a surface layer of a base steel sheet that lies directly under a plating layer which may crack during heavy machining. However, such control is difficult for conventional techniques; hence, it has been impossible to manufacture a galvanized steel sheet which has excellent anti-powdering property during heavy machining and which includes a base member that is a Si-containing high-strength steel sheet using a CGL including an annealing furnace that is an all-radiant tube-type furnace.

CITATION LIST

Patent Literature

PTL 1: Japanese Unexamined Patent Application Publication No. 2004-323970

PTL 2: Japanese Unexamined Patent Application Publication No. 2004-315960

PTL 3: Japanese Unexamined Patent Application Publication No. 2006-233333

SUMMARY OF INVENTION

Technical Problem

The present invention has been made in view of the foregoing circumstances and has an object to provide a galvanized steel sheet which includes a base member that is a steel sheet containing Si and Mn and which has excellent corrosion resistance, excellent anti-powdering property during heavy machining, and high strength and an object to provide a method for manufacturing such the galvanized steel sheet.

Solution to Problem

The present invention is as described below.

(1) A galvanized steel sheet includes a zinc plating layer which is disposed on a steel sheet containing 0.01% to 0.15% C, 0.001% to 2.0% Si, 0.1% to 3.0% Mn, 0.001% to 1.0% Al, 0.005% to 0.060% P, and 0.01% or less S on a mass basis, the remainder being Fe and unavoidable impurities, and which has a mass per unit area 20 g/m$^2$ to 120 g/m$^2$. An oxide of at least one selected from the group consisting of Fe, Si, Mn, Al, and P is present in a surface portion of the steel sheet that lies directly under the zinc plating layer and that extends up to 100 μm from the surface of a base steel sheet. The amount of the oxide per unit area is 0.05 g/m$^2$ or less in total.

(2) A galvanized steel sheet includes a zinc plating layer which is disposed on a steel sheet containing 0.01% to 0.15% C, 0.001% to 2.0% Si, 0.1% to 3.0% Mn, 0.001% to 1.0% Al, 0.005% to 0.060% P, and 0.01% or less S and at least one selected from the group consisting of 0.001% to 0.005% B, 0.005% to 0.05% Nb, 0.005% to 0.05% Ti, 0.001% to 1.0%

Cr, 0.05% to 1.0% Mo, 0.05% to 1.0% Cu, and 0.05% to 1.0% Ni on a mass basis, the remainder being Fe and unavoidable impurities, and which has a mass per unit area 20 g/m$^2$ to 120 g/m$^2$. An oxide of at least one selected from the group consisting of Fe, Si, Mn, Al, P, B, Nb, Ti, Cr, Mo, Cu, and Ni is present in a surface portion of the steel sheet that lies directly under the zinc plating layer and that extends up to 100 μm from the surface of a base steel sheet. The amount of the oxide per unit area is 0.05 g/m$^2$ or less in total.

(3) A method for manufacturing a galvanized steel sheet includes annealing and galvanizing the steel sheet specified in Item (1) or (2) in a continuous galvanizing line. The steel sheet is galvanized such that the partial pressure ($Po_2$) of oxygen in the atmosphere of an annealing furnace satisfies the following inequality at a temperature of 500° C. to 900° C.:

$$\text{Log } Po_2 \leq -14-0.7\times[\text{Si}]-0.3\times[\text{Mn}] \quad (1)$$

where [Si] represents the content (mass percent) of Si in steel, [Mn] represents the content (mass percent) of Mn in steel, and $Po_2$ represents the partial pressure (Pa) of oxygen.

(4) The galvanized steel sheet-manufacturing method specified in Item (3) further includes alloying the steel sheet by heating the steel sheet to a temperature of 450° C. to 550° C. subsequently to galvanizing such that the content of Fe in a plating layer ranges from 7% to 15% by mass.

(5) A high-strength galvanized steel sheet includes a zinc plating layer which is disposed on a steel sheet containing 0.01% to 0.15% C, 0.001% to 2.0% Si, 0.1% to 3.0% Mn, 0.001% to 1.0% Al, 0.005% to 0.060% P, and 0.01% or less S on a mass basis, the remainder being Fe and unavoidable impurities, and which has a mass per unit area 20 g/m$^2$ to 120 g/m$^2$. An oxide of at least one selected from the group consisting of Fe, Si, Mn, Al, and P is present in a surface portion of the steel sheet that lies directly under the zinc plating layer and that extends up to 100 μm from the surface of a base steel sheet. The amount of the oxide per unit area is 0.05 g/m$^2$ or less in total.

Advantageous Effects of Invention

According to the present invention, the following steel sheet is obtained: a galvanized steel sheet having excellent corrosion resistance, excellent anti-powdering property during heavy machining, and high strength.

DESCRIPTION OF EMBODIMENTS

In conventional techniques, internal oxides have been actively formed for the purpose of improving platability. This, however, deteriorates corrosion resistance and workability at the same time. Therefore, the inventors have investigated ways to satisfy all of platability, corrosion resistance, and workability by a novel method different from conventional approaches. As a result, the inventors have found that high corrosion resistance and good anti-powdering property during heavy machining can be achieved in such a manner that an internal oxide is inhibited from being formed in a surface portion of a steel sheet that lies directly under a plating layer by appropriately determining the atmosphere and temperature of an annealing step.

In particular, an oxide of at least one selected from the group consisting of Fe, Si, Mn, Al, and P (Fe only is excluded) and optimally selected from the group consisting of B, Nb, Ti, Cr, Mo, Cu, and Ni is inhibited from being formed in a surface portion of a base steel sheet that lies directly under a zinc plating layer and that extends up to 100 μm from the surface of the steel sheet and the amount of the oxide formed per unit area is suppressed to 0.05 g/m$^2$ or less in total. This significantly increases the corrosion resistance and enables the surface portion of the base steel sheet to be prevented from cracking during bending, resulting in a finding that a high-strength galvanized steel sheet with excellent anti-powdering property during heavy machining is obtained.

The term "high-strength galvanized steel sheet" as used herein refers to a steel sheet with a tensile stress TS of 340 MPa or more. Examples of a high-strength galvanized steel sheet according to the present invention include plated steel sheets (hereinafter referred to as GI in some cases) that are not alloyed subsequently to galvanizing and alloyed plated steel sheets (hereinafter referred to as GA in some cases).

The present invention is described below in detail. In descriptions below, the content of each element in steel and the content of each element in a plating layer are both expressed in "% by mass" and are hereinafter simply expressed in "%" unless otherwise specified.

The composition of steel is first described.

C: 0.01% to 0.15%

C forms martensite, which is a steel microstructure, to increase workability. This requires that the content of C is 0.01% or more. In contrast, when the C content is greater than 0.15%, weldability is reduced. Thus, the C content is 0.01% to 0.15%.

Si: 0.001% to 2.0%

Si is an element effective in obtaining a good material by strengthening steel. In order to achieve a strength intended in the present invention, the content of Si needs to be 0.001% or more. When the Si content is less than 0.001%, a strength within the scope of the present invention is not achieved or anti-powdering property during heavy machining is not particularly problematic. In contrast, when the Si content is greater than 2.0%, it is difficult to improve anti-powdering property during heavy machining. Thus, the Si content is 0.001% to 2.0%.

Mn: 0.1% to 3.0%

Mn is an element effective in strengthening steel. In order to ensure mechanical properties and strength, the content of Mn needs to be 0.1% or more. In contrast, when the Mn content is greater than 3.0%, it is difficult to ensure weldability, coating adhesion, and a balance between strength and ductility. Thus, the Mn content is 0.1% to 3.0%.

Al: 0.001% to 1.0%

Al is contained for the purpose of deoxidizing molten steel. This objective is not accomplished when the content of Al is less than 0.001%. The effect of deoxidizing molten steel is achieved when the Al content is 0.001% or more. In contrast, when the Al content is greater than 1.0%, an increase in cost is caused. Thus, the Al content is 0.01% to 1.0%.

P: 0.005% to 0.060%

P is one of unavoidably contained elements. The content of P is 0.005% or more because adjusting the P content to less than 0.005% is likely to cause an increase in cost. When the P content is greater than 0.060%, weldability is reduced. Surface quality is also low. Furthermore, coating adhesion deteriorates during alloying and therefore a desired degree of alloying cannot be achieved unless the alloying temperature is increased during alloying. If the alloying temperature is increased for the purpose of achieving a desired degree of alloying, ductility deteriorates and the adhesion of an alloyed coating deteriorates; hence, a desired degree of alloying, good ductility, and the alloyed coating cannot be balanced. Thus, the P content is 0.005% to 0.060%.

S≤0.01%

S is one of unavoidably contained elements. The content of S, of which the lower limit is not limited, is preferably 0.01% or less because weldability is low when the S content is large.

In order to control the balance between strength and ductility, the following element may be contained as required: at least one selected from the group consisting of 0.001% to 0.005% B, 0.005% to 0.05% Nb, 0.005% to 0.05% Ti, 0.001% to 1.0% Cr, 0.05% to 1.0% Mo, 0.05% to 1.0% Cu, and 0.05% to 1.0% Ni. When these elements are contained, the reason for limiting the appropriate content of each element is as described below.

B: 0.001% to 0.005%

B is ineffective in achieving the effect of accelerating hardening when the content of B is less than 0.001%. In contrast, when the B content is greater than 0.005%, coating adhesion is reduced. When B is contained, the B content is therefore 0.001% to 0.005%. However, of course, B need not be contained if it is decided that B need not be used to improve mechanical properties.

Nb: 0.005% to 0.05%

When the content of Nb is less than 0.005%, the effect of adjusting strength is unlikely to be achieved and/or the effect of improving coating adhesion is unlikely to be achieved if Mo is contained. In contrast, when the Nb content is greater than 0.05%, an increase in cost is caused. When Nb is contained, the Nb content is therefore 0.005% to 0.05%.

Ti: 0.005% to 0.05%

When the content of Ti is less than 0.005%, the effect of adjusting strength is unlikely to be achieved. In contrast, when the Ti content is greater than 0.05%, a reduction in coating adhesion is caused. When Ti is contained, the Ti content is therefore 0.005% to 0.05%.

Cr: 0.001% to 1.0%

When the content of Cr is less than 0.001%, a hardening effect is unlikely to be achieved. In contrast, when the Cr content is greater than 1.0%, coating adhesion and weldability are reduced because Cr concentrates at the surface. When Cr is contained, the Cr content is therefore 0.001% to 1.0%.

Mo: 0.05% to 1.0%

When the content of Mo is less than 0.05%, the effect of adjusting strength is unlikely to be achieved and/or the effect of improving coating adhesion is unlikely to be achieved in the case of using Ni or Cu in combination with Mo. In contrast, when the Mo content is greater than 1.0%, an increase in cost is caused. When Mo is contained, the Mo content is therefore 0.05% to 1.0%.

Cu: 0.05% to 1.0%

When the content of Cu is less than 0.05%, the effect of accelerating the formation of a retained γ-phase is unlikely to be achieved and/or the effect of improving coating adhesion is unlikely to be achieved in the case of using Ni or Mo in combination with Cu. In contrast, when the Cu content is greater than 1.0%, an increase in cost is caused. When Cu is contained, the Cu content is therefore 0.05% to 1.0%.

Ni: 0.05% to 1.0%

When the content of Ni is less than 0.05%, the effect of accelerating the formation of a retained γ-phase is unlikely to be achieved and/or the effect of improving coating adhesion is unlikely to be achieved in the case of using Cu or Mo in combination with Ni. In contrast, when the Ni content is greater than 1.0%, an increase in cost is caused. When Ni is contained, the Ni content is therefore 0.05% to 1.0%.

The remainder other than those described above is Fe and unavoidable impurities.

The surface structure of a base steel sheet disposed directly under a plating layer is the most important requirement in the present invention and is described below.

In order to allow a high-strength galvanized steel sheet made from steel containing a large amount of Si and Mn to have satisfactory corrosion resistance and anti-powdering property during heavy machining, the following oxide needs to be minimized: an internal oxide which may possibly cause corrosion or cracking during heavy machining and which is present in a surface layer of the base steel sheet that lies directly under the plating layer.

Platability can be increased by accelerating the internal oxidation of Si and Mn. This, however, causes a reduction in corrosion resistance or workability. Therefore, corrosion resistance and workability need to be increased by a method other than accelerating the internal oxidation of Si and Mn while good platability is maintained and internal oxidation is inhibited.

As a result of investigation, in the present invention, the potential of oxygen is reduced in an annealing step for the purpose of ensuring platability, whereby the activity of oxidizable elements, such as Si and Mn, in a surface portion of a base member is reduced. The external oxidation of these elements is inhibited, whereby platability is improved. The internal oxide is also inhibited from being formed in the surface portion of the base member, whereby corrosion resistance and workability are improved. Such effects are exhibited by suppressing the amount of an oxide of at least one selected from the group consisting of Fe, Si, Mn, Al, P, B, Nb, Ti, Cr, Mo, Cu, and Ni to 0.05 $g/m^2$ or less in total, the oxide being formed in a surface portion of a steel sheet that extends up to 100 μm from the surface of the base member. When the total amount of the oxide formed therein (hereinafter referred to as the internal oxide amount) is greater than 0.05 $g/m^2$, corrosion resistance and workability are reduced. Even if the internal oxide amount is suppressed to less than 0.0001 $g/m^2$, the effect of increasing corrosion resistance and workability is saturated; hence, the lower limit of the internal oxide amount is preferably 0.0001 $g/m^2$ or more.

The internal oxide amount can be measured by "impulse furnace fusion-infrared absorption spectrometry". The amount of oxygen contained in the base member (that is, an unannealed high-tension steel sheet) needs to be excluded. Therefore, in the present invention, portions of both surfaces of the continuously annealed high-tension steel sheet are polished by 100 μm or more, the continuously annealed high-tension steel sheet is measured for oxygen concentration, and a measurement thereby obtained is defined as the oxygen amount OH of the base member. Furthermore, the continuously annealed high-tension steel sheet is measured for oxygen concentration in the thickness direction thereof and a measurement thereby obtained is defined as the oxygen amount OI of the internally oxidized high-tension steel sheet. The difference (OI—OH) between OI and OH is calculated using the oxygen amount OI of the internally oxidized high-tension steel sheet and the oxygen amount OH of the base member and is then converted into a value ($g/m^2$) per unit area (that is, 1 $m^2$), which is used as the internal oxide amount.

In the present invention, the amount of the oxide of at least one selected from the group consisting of Fe, Si, Mn, Al, P, B, Nb, Ti, Cr, Mo, Cu, and Ni is suppressed to 0.05 $g/m^2$ or less in total, the oxide being formed in the surface portion of the steel sheet that lies directly under the zinc plating layer and that extends up to 100 μm from the surface of the base steel sheet.

In order to suppress the amount of the oxide of at least one selected from the group consisting of Fe, Si, Mn, Al, P, B, Nb, Ti, Cr, Mo, Cu, and Ni (Fe only is excluded) to 0.05 g/m$^2$ or less in total, the oxide being formed in the surface portion of the steel sheet that extends up to 100 μm from the surface of the base member as described above, upon galvanizing the annealed steel sheet in a continuous galvanizing line including an annealing furnace that is an all-radiant tube-type furnace, the partial pressure ($Po_2$) of oxygen in the atmosphere of the annealing furnace needs to satisfy the following inequality at a temperature of 500° C. to 900° C.:

$$\text{Log } Po_2 \leq -14-0.7\times[Si]-0.3\times[Mn]$$

wherein [Si] represents the content (mass percent) of Si in steel, [Mn] represents the content (mass percent) of Mn in steel, and $Po_2$ represents the partial pressure (Pa) of oxygen.

At a temperature of lower than 500° C., a selective external oxidation (surface concentration) reaction does not occur at a surface layer of the base member and therefore there is no problem even if the present invention is used. In contrast, at a temperature of higher than 900° C., internal oxidation is accelerated and therefore the amount of the oxide is likely to exceed 0.05 g/m$^2$. Thus, the temperature at which the partial pressure ($Po_2$) of oxygen in the atmosphere is controlled and which satisfies the above inequality is 500° C. to 900° C.

For comparison under the same conditions, the surface concentration of Si or Mn increases in proportion to the content of Si or Mn, respectively, in steel. For the same kind of steel, the surface concentration reduces with a reduction in the potential of oxygen in the atmosphere. Therefore, in order to reduce the surface concentration, the potential of oxygen in the atmosphere needs to be reduced in proportion to the content of Si or Mn in steel. In this relationship, the proportionality factor of the content of Si in steel and the proportionality factor of the content of Mn in steel are experimentally known to be −0.7 and −0.3, respectively. Furthermore, the intercept is also known to be −14. In the present invention, the upper limit of Log $Po_2$ is given by the formula $-14-0.7\times[Si]-0.3\times[Mn]$. When Log $Po_2$ exceeds the value of the formula $-14-0.7\times[Si]-0.3\times[Mn]$, the internal oxidation of Si and Mn is accelerated and therefore the internal oxide amount exceeds 0.05 g/m$^2$. When Log $Po_2$ falls below −17, no problem arises; however, the cost of controlling the atmosphere increases. Thus, the lower limit of Log $Po_2$ is preferably −17.

Since Log $Po_2$ can be determined from the concentrations of $H_2O$ and $H_2$ calculated from the dew point by equilibrium calculation, Log $Po_2$ is not directly measured or controlled but is preferably controlled in such a manner that the $H_2O$ and $H_2$ concentrations are controlled. Herein, Log $Po_2$ can be calculated from the following equation:

$$Po_2=(PH_2O/PH_2)^2\times\exp(\Delta G/RT) \quad (2)$$

wherein ΔG is the Gibbs free energy, R is the gas constant, and T is the temperature.

A method for measuring the $H_2O$ and $H_2$ concentrations is not particularly limited. For example, a predetermined amount of gas is sampled and is then measured for dew point with a dew-point meter (such as a due cup), whereby the partial pressure of $H_2O$ is determined. Furthermore, the sampled gas is measured with a $H_2$ concentration meter, whereby the $H_2$ concentration is determined. Alternatively, the pressure in the atmosphere is measured and the partial pressures of $H_2O$ and $H_2$ are calculated from the concentration ratio thereof.

When $Po_2$ is high, the dew point is reduced by introducing a $N_2$—$H_2$ gas or the $H_2$ concentration is increased. In contrast, when $Po_2$ is low, the dew point is increased by introducing a $N_2$—$H_2$ gas containing a large amount of steam or a slight amount of an $O_2$ gas is mixed.

In addition, in the present invention, the microstructure of the base steel sheet, on which a Si—Mn composite oxide is grown, is preferably a ferritic phase which is soft and which has good workability in order to increase anti-powdering property.

Furthermore, in the present invention, the surface of the steel sheet has a zinc plating layer with a mass per unit area of 20 g/m$^2$ to 120 g/m$^2$. When the mass per unit area thereof is less than 20 g/m$^2$, it is difficult to ensure the corrosion resistance. In contrast, when the mass per unit area thereof is greater than 120 g/m$^2$, the anti-powdering property is reduced.

In the case where alloying is performed at a temperature 450° C. to 550° C. subsequently to galvanizing, the degree of alloying is preferably 7% to 15%. When the degree of alloying is less than 7%, uneven alloying occurs or flaking properties are reduced. In contrast, when the degree of alloying is greater than 15%, anti-powdering property is reduced.

A method for manufacturing a galvanized steel sheet according to the present invention and the reason for limitation are described below.

After steel containing the above components is hot-rolled, cold rolling is performed at a reduction of 40% to 80% and annealing and galvanizing are performed in a continuous galvanizing line including an all-radiant tube-type furnace. Galvanizing is performed such that the partial pressure ($Po_2$) of oxygen in the atmosphere of an annealing furnace satisfies Inequality (1) below at a temperature of 500° C. to 900° C. This is the most important requirement in the present invention. The control of the partial pressure ($Po_2$) of oxygen in the atmosphere in an annealing and/or galvanizing step reduces the potential of oxygen; reduces the activity of oxidizable elements, such as Si and Mn, in a surface portion of a base member; inhibits an internal oxide from being formed in the surface portion of the base member; and improves the corrosion resistance and the workability.

$$\text{Log } Po_2 \leq -14-0.7\times[Si]-0.3\times[Mn] \quad (1)$$

In this inequality, [Si] represents the content (mass percent) of Si in steel, [Mn] represents the content (mass percent) of Mn in steel, and $Po_2$ represents the partial pressure (Pa) of oxygen.

Hot-rolling conditions are not particularly limited. Pickling is preferably performed subsequently to hot rolling. Surface scales are removed in a pickling step and cold rolling is performed.

Cold rolling is performed at a reduction of 40% to 80%. When the reduction is less than 40%, the temperature of recrystallization decreases and therefore mechanical properties are likely to be reduced. In contrast, when the reduction is greater than 80%, the cost of rolling a high-strength steel sheet is high and plating properties are reduced because surface concentration is increased during annealing.

After a cold-rolled steel sheet is annealed in a CGL including an annealing furnace that is an all-radiant tube-type furnace, the cold-rolled steel sheet is galvanized or further alloyed.

A step of heating the steel sheet to a predetermined temperature is performed in a heating zone located at an upstream section of the all-radiant tube-type furnace and a step of soaking the steel sheet at a predetermined temperature for a predetermined time is performed in a soaking zone located at a downstream section thereof.

In order to suppress the amount of the oxide of at least one selected from the group consisting of Fe, Si, Mn, Al, P, B, Nb, Ti, Cr, Mo, Cu, and Ni to 0.05 g/m$^2$ or less, the oxide being formed in a surface portion of the steel sheet that extends up to 100 μm from the surface of the base member, the partial pressure ($Po_2$) of oxygen in the atmosphere of the annealing furnace needs to satisfy the inequality below at a temperature of 500° C. to 900° C. during galvanizing as described above. Therefore, in the CGL, the dew point is reduced by introducing a $N_2$—$H_2$ gas or the $H_2$ concentration is increased when $Po_2$ is high and the dew point is increased by introducing a $N_2$—$H_2$ gas containing a large amount of steam or a slight amount of an $O_2$ gas is mixed when $Po_2$ is low, whereby the concentrations of $H_2O$ and $H_2$ are controlled and thereby Log $Po_2$ is controlled.

$$\text{Log } Po_2 \leq -14-0.7\times[Si]-0.3\times[Mn]$$

In this inequality, [Si] represents the content (mass percent) of Si in steel, [Mn] represents the content (mass percent) of Mn in steel, and $Po_2$ represents the partial pressure (Pa) of oxygen.

When the volume fraction of $H_2$ is less than 10%, an activation effect due to reduction is not achieved and therefore anti-powdering property is reduced. The upper limit of the volume fraction of $H_2$ is not particularly limited. When the upper limit thereof is greater than 75%, cost is high and such an effect is saturated. Therefore, the volume fraction of $H_2$ is preferably 75% or less in view of cost.

A galvanizing process may be a common one.

In the case of performing alloying subsequently to galvanizing, the steel sheet is preferably heated to a temperature of 450° C. to 550° C. subsequently to galvanizing and then alloyed such that the Fe content of a plating layer is 7% to 15% by mass.

EXAMPLES

The present invention is described below in detail with reference to examples.

Hot-rolled steel sheets having compositions shown in Table 1 were pickled, whereby scales were removed therefrom. The hot-rolled steel sheets were cold-rolled under conditions shown in Table 2, whereby cold-rolled steel sheets with a thickness of 1.0 mm were obtained.

Each cold-rolled steel sheet obtained as described above was provided in a CGL including an annealing furnace that was an all-radiant tube-type furnace. In the CGL, $Po_2$ of an annealing atmosphere was controlled as shown in Table 2 and the cold-rolled steel sheet was transported, was heated to 850° C. in a heating zone, was annealed by soaking the cold-rolled steel sheet at 850° C. in a soaking zone, and was then galvanized in a 460° C. Al-containing Zn bath. The atmosphere in the annealing furnace including a heating furnace and a soaking furnace may be considered to be substantially uniform. The partial pressure of oxygen and the temperature were measured in such a manner that an atmosphere gas was taken from a center portion (actually a portion 1 m apart from the bottom of the annealing furnace to the operation side (Op side)) of the annealing furnace.

The dew point of the atmosphere therein was controlled in such a manner that a pipe was provided in advance such that a humidified $N_2$ gas generated by heating a water tank placed in $N_2$ flowed through the pipe, the humidified $N_2$ gas was mixed with a $H_2$ gas by introducing the $H_2$ gas into the humidified $N_2$ gas, and the mixture was introduced into the annealing furnace. The percentage of $H_2$ in the atmosphere was controlled in such a manner that the flow rate of the $H_2$ gas introduced into the humidified $N_2$ gas was regulated with a gas valve.

A 0.14% Al-containing Zn bath was used to manufacture GAs. A 0.18% Al-containing Zn bath was used to manufacture GIs. The mass per unit area was adjusted to 40 g/m$^2$, 70 g/m$^2$, or 130 g/m$^2$ (mass per unit area) by gas wiping. Some of them were alloyed.

The galvannealed steel sheets (GAs and GIs) obtained as described above were checked for appearance (coating appearance), corrosion resistance, anti-powdering property during heavy machining, and workability. The amount of the following oxide was measured: an internal oxide present in a surface portion of a base steel sheet that lied directly under a plating layer and that extended up to 100 μm from the plating layer. A measuring method and evaluation standards were as described below.

TABLE 1

(mass percent)

| Steel symbol | C | Si | Mn | Al | P | S | Cr | Mo | B | Nb | Cu | Ni | Ti |
|---|---|---|---|---|---|---|---|---|---|---|---|---|---|
| A | 0.02 | 0.2 | 1.9 | 0.03 | 0.01 | 0.004 | — | — | — | — | — | — | — |
| B | 0.05 | 0.2 | 2.0 | 0.03 | 0.01 | 0.004 | — | — | — | — | — | — | — |
| C | 0.15 | 0.2 | 2.1 | 0.03 | 0.01 | 0.004 | — | — | — | — | — | — | — |
| D | 0.05 | 1.0 | 2.0 | 0.03 | 0.01 | 0.004 | — | — | — | — | — | — | — |
| E | 0.05 | 1.9 | 2.1 | 0.03 | 0.01 | 0.004 | — | — | — | — | — | — | — |
| F | 0.05 | 0.2 | 2.9 | 0.03 | 0.01 | 0.004 | — | — | — | — | — | — | — |
| G | 0.05 | 0.2 | 2.0 | 0.9 | 0.01 | 0.004 | — | — | — | — | — | — | — |
| H | 0.05 | 0.2 | 2.1 | 0.03 | 0.05 | 0.004 | — | — | — | — | — | — | — |
| I | 0.05 | 0.2 | 1.9 | 0.03 | 0.01 | 0.009 | — | — | — | — | — | — | — |
| J | 0.05 | 0.2 | 1.9 | 0.02 | 0.01 | 0.004 | 0.8 | — | — | — | — | — | — |
| K | 0.05 | 0.2 | 1.9 | 0.03 | 0.01 | 0.004 | — | 0.1 | — | — | — | — | — |
| L | 0.05 | 0.2 | 2.2 | 0.03 | 0.01 | 0.004 | — | — | 0.003 | — | — | — | — |
| M | 0.05 | 0.2 | 2.0 | 0.05 | 0.01 | 0.004 | — | — | 0.001 | 0.03 | — | — | — |
| N | 0.05 | 0.2 | 1.9 | 0.03 | 0.01 | 0.004 | — | 0.1 | — | — | 0.1 | 0.2 | — |
| O | 0.05 | 0.2 | 1.9 | 0.04 | 0.01 | 0.004 | — | — | 0.001 | — | — | — | 0.02 |
| P | 0.05 | 0.2 | 1.9 | 0.03 | 0.01 | 0.004 | — | — | — | — | — | — | 0.05 |
| Q | 0.16 | 0.2 | 2.2 | 0.03 | 0.01 | 0.004 | — | — | — | — | — | — | — |
| R | 0.02 | 2.1 | 2.0 | 0.03 | 0.01 | 0.004 | — | — | — | — | — | — | — |
| S | 0.02 | 0.2 | 3.1 | 0.03 | 0.01 | 0.004 | — | — | — | — | — | — | — |
| T | 0.02 | 0.2 | 1.9 | 1.1 | 0.01 | 0.004 | — | — | — | — | — | — | — |
| U | 0.02 | 0.2 | 1.9 | 0.03 | 0.07 | 0.004 | — | — | — | — | — | — | — |
| V | 0.02 | 0.2 | 1.9 | 0.03 | 0.01 | 0.011 | — | — | — | — | — | — | — |

<Appearance>

For appearance, a steel sheet with no appearance defect such as an unplated portion or an unevenly alloyed portion was judged to be good in appearance (symbol A) and a steel sheet with an appearance defect was judged to be bad in appearance (symbol B).

<Corrosion Resistance>

Each galvannealed steel sheet with a size of 70 mm×150 mm was subjected to a salt spray test in accordance with JIS Z 2371 (in 2000) for three days, was washed with chromic acid (a concentration of 200 g/L, 80° C.) for one minute such that corrosion products were removed therefrom, was measured for corrosion weight loss per unit area ($g/m^2 \cdot day$) by gravimetry before and after the test, and was then evaluated in accordance with standards below.

A (good): less than 20 $g/m^2 \cdot day$

B (bad): 20 $g/m^2 \cdot day$ or more

<Anti-Powdering Property>

A GA needs to have anti-powdering property during heavy machining, that is, a coating needs to be inhibited from being peeled from a bent portion of a plated steel sheet which is bent to more than 90 degrees so as to form an acute angle. In this example, tapes were peeled from 120-degree bent portions and the amount of each peeled portion per unit length was determined by X-ray fluorescence in the form of the number of Zn counts. In light of standards below, those having a rank of 1 or 2 were evaluated to be good (symbol A) and those having a rank of 3 or more were evaluated to be bad (symbol B)

Number of X-ray fluorescence Zn counts: Rank 0 to less than 500:1 (good)

500 to less than 1000:2

1000 to less than 2000: 3

2000 to less than 3000: 4

3000 or more: 5 (inferior)

A GI needs to have anti-powdering property during impact testing. Ball impact testing was performed, tapes were peeled from machined portions, and whether plating layers were peeled off was visually checked.

A: no peeled plating layer

B: peeled plating layer

<Workability>

Each sample was evaluated for workability in such a manner that a JIS No. 5 tensile test piece extending in the 90 degree direction with respect to the rolling direction thereof was taken from the sample, was subjected to tensile testing at a constant cross-head speed of 10 mm/min in accordance with JIS Z 2241 requirements, and was then determined for tensile strength (TS (MPa)) and elongation (El (%)). Those satisfying the inequality TS×El≥122000 were evaluated to be good and those satisfying the inequality TS×El<22000 were evaluated to be bad.

Results obtained as described above are shown in Table 2 in combination with manufacturing conditions.

<Internal Oxide Amount>

The internal oxide amount is measured by "impulse furnace fusion-infrared absorption spectrometry". The amount of oxygen contained in a base member (that is, an unannealed high-tension steel sheet) needs to be excluded.

Therefore, in the present invention, portions of both surfaces of the continuously annealed high-tension steel sheet were polished by 100 μm or more, the continuously annealed high-tension steel sheet was measured for oxygen concentration, and a measurement thereby obtained was defined as the oxygen amount OH of the base member. Furthermore, the continuously annealed high-tension steel sheet was measured for oxygen concentration in the thickness direction thereof and a measurement thereby obtained was defined as the oxygen amount OI of the internally oxidized high-tension steel sheet. The difference (OI—OH) between OI and OH was calculated using the oxygen amount OI of the internally oxidized high-tension steel sheet and the oxygen amount OH of the base member and was then converted into a value ($g/m^2$) per unit area (that is, 1 $m^2$), which was used as the internal oxide amount.

TABLE 2

| | Steels | | | Manufacturing methods | | | | | | | | |
|---|---|---|---|---|---|---|---|---|---|---|---|---|
| No. | Symbol | Si % | Mn % | Cold rolling reduction (%) | Annealing Log $Po_2$ | −14 − 0.7 × [Si] − 0.3 × [Mn] | Whether −17 ≤ Log $Po_2$ ≤ −14 − 0.7 × [Si] − 0.3 × [Mn] is satisfied at a temperature of 500° C. to 900° C. | Alloying temperature (° C.) | Internal oxide amount ($g/m^2$) | mass per unit area ($g/m^2$) | Plating type | Content of Fe in plating layer (mass percent) |
| 1 | A | 0.2 | 1.9 | 50 | −16 | −14.7 | Satisfied | 500 | 0.001 | 40 | GA | 10 |
| 2 | A | 0.2 | 1.9 | 50 | −15 | −14.7 | Satisfied | 500 | 0.012 | 40 | GA | 10 |
| 3 | A | 0.2 | 1.9 | 50 | −15 | −14.7 | Satisfied | — | 0.012 | 70 | GI | — |
| 4 | A | 0.2 | 1.9 | 50 | −12 | −14.7 | Not satisfied | — | 0.080 | 70 | GI | — |
| 5 | A | 0.2 | 1.9 | 50 | −15 | −14.7 | Satisfied | 500 | 0.012 | 130 | GA | 10 |
| 6 | A | 0.2 | 1.9 | 50 | −14 | −14.7 | Not satisfied | 500 | 0.052 | 40 | GA | 10 |
| 7 | A | 0.2 | 1.9 | 50 | −12 | −14.7 | Not satisfied | 500 | 0.080 | 40 | GA | 10 |
| 8 | B | 0.2 | 2.0 | 50 | −15 | −14.7 | Satisfied | 500 | 0.030 | 40 | GA | 10 |
| 9 | C | 0.2 | 2.1 | 50 | −15 | −14.8 | Satisfied | 500 | 0.040 | 40 | GA | 10 |
| 10 | D | 1.0 | 2.0 | 50 | −16 | −15.3 | Satisfied | 500 | 0.050 | 40 | GA | 10 |
| 11 | E | 1.9 | 2.1 | 50 | −15 | −16.0 | Satisfied | 500 | 0.040 | 40 | GA | 10 |
| 12 | F | 0.2 | 2.9 | 50 | −15 | −15.0 | Satisfied | 500 | 0.030 | 40 | GA | 10 |
| 13 | G | 0.2 | 2.0 | 50 | −15 | −14.7 | Satisfied | 500 | 0.020 | 40 | GA | 10 |
| 14 | H | 0.2 | 2.1 | 50 | −15 | −14.8 | Satisfied | 500 | 0.030 | 40 | GA | 10 |
| 15 | I | 0.2 | 1.9 | 50 | −15 | −14.7 | Satisfied | 500 | 0.030 | 40 | GA | 10 |
| 16 | J | 0.2 | 1.9 | 50 | −15 | −14.7 | Satisfied | 500 | 0.030 | 40 | GA | 10 |
| 17 | K | 0.2 | 1.9 | 50 | −15 | −14.7 | Satisfied | 500 | 0.030 | 40 | GA | 10 |
| 18 | L | 0.2 | 2.2 | 50 | −15 | −14.8 | Satisfied | 500 | 0.030 | 40 | GA | 10 |
| 19 | M | 0.2 | 2.0 | 50 | −15 | −14.7 | Satisfied | 500 | 0.030 | 40 | GA | 10 |
| 20 | N | 0.2 | 1.9 | 50 | −15 | −14.7 | Satisfied | 500 | 0.030 | 40 | GA | 10 |
| 21 | O | 0.2 | 1.9 | 50 | −15 | −14.7 | Satisfied | 500 | 0.030 | 40 | GA | 10 |
| 22 | P | 0.2 | 1.9 | 50 | −15 | −14.7 | Satisfied | 500 | 0.030 | 40 | GA | 10 |

TABLE 2-continued

| | | | | | | | | | | | | |
|---|---|---|---|---|---|---|---|---|---|---|---|---|
| 23 | Q | 0.2 | 2.2 | 50 | −15 | −14.8 | Satisfied | 500 | 0.030 | 40 | GA | 10 |
| 24 | R | 2.1 | 2.0 | 50 | −17 | −16.1 | Satisfied | 500 | 0.210 | 40 | GA | 10 |
| 25 | S | 0.2 | 3.1 | 50 | −16 | −15.1 | Satisfied | 500 | 0.050 | 40 | GA | 10 |
| 26 | T | 0.2 | 1.9 | 50 | −15 | −14.7 | Satisfied | 500 | 0.030 | 40 | GA | 10 |
| 27 | U | 0.2 | 1.9 | 50 | −15 | −14.7 | Satisfied | 500 | 0.030 | 40 | GA | 10 |
| 28 | V | 0.2 | 1.9 | 50 | −15 | −14.7 | Satisfied | 500 | 0.030 | 40 | GA | 10 |

| | Steels | | | | | Anti- | | | | | |
|---|---|---|---|---|---|---|---|---|---|---|---|
| No. | Symbol | Si % | Mn % | Coating appearance | Corrosion resistance | powdering property | TS (%) | El (%) | TS × El | Workability | Remarks |
| 1 | A | 0.2 | 1.9 | A | A | A | 625 | 37.5 | 23438 | Good | Example of invention |
| 2 | A | 0.2 | 1.9 | A | A | A | 628 | 37.1 | 23299 | Good | Example of invention |
| 3 | A | 0.2 | 1.9 | A | A | A | 626 | 37.4 | 23412 | Good | Example of invention |
| 4 | A | 0.2 | 1.9 | B | A | A | 623 | 38.2 | 23799 | Good | Example of invention |
| 5 | A | 0.2 | 1.9 | A | A | B | 625 | 38.1 | 23813 | Good | Example of invention |
| 6 | A | 0.2 | 1.9 | A | B | B | 628 | 37.2 | 23362 | Good | Example of invention |
| 7 | A | 0.2 | 1.9 | A | B | B | 626 | 37.5 | 23475 | Good | Example of invention |
| 8 | B | 0.2 | 2.0 | A | A | A | 799 | 29.3 | 23411 | Good | Example of invention |
| 9 | C | 0.2 | 2.1 | A | A | A | 1123 | 20.3 | 22797 | Good | Example of invention |
| 10 | D | 1.0 | 2.0 | A | A | A | 1039 | 21.3 | 22131 | Good | Example of invention |
| 11 | E | 1.9 | 2.1 | A | A | A | 1099 | 20.4 | 22420 | Good | Example of invention |
| 12 | F | 0.2 | 2.9 | A | A | A | 1089 | 20.3 | 22107 | Good | Example of invention |
| 13 | G | 0.2 | 2.0 | A | A | A | 1166 | 19.9 | 23203 | Good | Example of invention |
| 14 | H | 0.2 | 2.1 | A | A | A | 1346 | 16.9 | 22747 | Good | Example of Invention |
| 15 | I | 0.2 | 1.9 | A | A | A | 1089 | 20.8 | 22651 | Good | Example of invention |
| 16 | J | 0.2 | 1.9 | A | A | A | 1069 | 22.1 | 23625 | Good | Example of invention |
| 17 | K | 0.2 | 1.9 | A | A | A | 1155 | 20.6 | 23793 | Good | Example of invention |
| 18 | L | 0.2 | 2.2 | A | A | A | 1192 | 19.4 | 23125 | Good | Example of invention |
| 19 | M | 0.2 | 2.0 | A | A | A | 1092 | 20.6 | 22495 | Good | Example of invention |
| 20 | N | 0.2 | 1.9 | A | A | A | 1165 | 20.1 | 23417 | Good | Example of invention |
| 21 | O | 0.2 | 1.9 | A | A | A | 1187 | 19.4 | 23028 | Good | Example of invention |
| 22 | P | 0.2 | 1.9 | A | A | A | 1085 | 21.1 | 22894 | Good | Example of invention |
| 23 | Q | 0.2 | 2.2 | A | A | A | 1546 | 14.3 | 22108 | Bad | Comparative example |
| 24 | R | 2.1 | 2.0 | B | A | B | 621 | 45.6 | 28318 | Bad | Comparative example |
| 25 | S | 0.2 | 3.1 | B | A | B | 717 | 36.5 | 26171 | Bad | Comparative example |
| 26 | T | 0.2 | 1.9 | B | A | A | 669 | 38.3 | 25623 | Bad | Comparative example |
| 27 | U | 0.2 | 1.9 | B | A | B | 898 | 25.9 | 23258 | Bad | Comparative example |
| 28 | V | 0.2 | 1.9 | A | A | A | 736 | 36.1 | 26570 | Bad | Comparative example |

As is clear from Table 2, GIs and GAs (examples of the present invention) manufactured by a method according to the present invention are high-strength steel sheets containing a large amount of an oxidizable element such as Si or Mn and, however, have excellent corrosion resistance, excellent workability, excellent anti-powdering property during heavy machining, and good coating appearance.

In contrast, comparative examples have one or more of inferior coating appearance, corrosion resistance, workability, and anti-powdering property during heavy machining.

Industrial Applicability

A galvanized steel sheet according to the present invention has excellent corrosion resistance, anti-powdering property during heavy machining, and strength and therefore can be used as a surface-treated steel sheet for lightweight high-strength automobile bodies. Furthermore, the galvanized steel sheet can be widely used in fields, such as home appliances and building materials, other than automobiles in the form of a surface-treated steel sheet manufactured by imparting corrosion resistance to a base steel sheet.

The invention claimed is:

1. A method for manufacturing a galvanized steel sheet, comprising:

annealing and galvanizing a steel sheet in a continuous galvanizing line, wherein the steel sheet is galvanized such that the partial pressure ($Po_2$) of oxygen in the atmosphere of an all-radiant tube annealing furnace satisfies the following inequality at a temperature of 500° C. to 900° C.:

$$\text{Log } Po_2 \leq -14-0.7\times[Si]-0.3\times[Mn] \quad (1)$$

where [Si] represents a content in mass percent of Si in steel, [Mn] represents a content in mass percent of Mn in steel, and $Po_2$ represents a partial pressure (Pa) of oxygen, wherein the steel sheet contains a zinc plating layer, and an oxide of at least one selected from the group consisting of Fe, Si, Mn, Al, P, B, Nb, Ti, Cr, Mo, Cu, and Ni is present in a surface portion of the steel sheet that lies directly under the zinc plating layer and that extends up to 100 μm from the surface of a base steel sheet, the content of Si is from 0.001% to 0.2% by mass, and an amount of oxide per unit area is 0.05 g/m$^2$ or less.

2. The galvanized steel sheet-manufacturing method according to claim 1, further comprising alloying the steel sheet by heating the steel sheet to a temperature of 450° C. to 550° C. subsequently to galvanizing such that the content of Fe in a plating layer ranges from 7% to 15% by mass.

3. A method for manufacturing a galvanized steel sheet, comprising:

heating a steel sheet in a heating zone;

annealing the steel sheet in a soaking zone; and galvanizing the steel sheet in a continuous galvanizing line, wherein the steel sheet is galvanized such that the partial pressure ($Po_2$) of oxygen in the atmosphere of an all-radiant tube annealing furnace satisfies the following inequality at a temperature of 500° C. to 900° C.:

$$\text{Log } Po_2 \leq -14-0.7\times[Si]-0.3\times[Mn] \quad (1)$$

where [Si] represents a content in mass percent of Si in steel, [Mn] represents a content in mass percent of Mn in steel, and $Po_2$ represents a partial pressure (Pa) of oxygen, wherein the steel sheet contains a zinc plating layer, and an oxide of at least one selected from the group consisting of Fe, Si, Mn, Al, P, B, Nb, Ti, Cr, Mo, Cu, and Ni is present in a surface portion of the steel sheet that lies directly under the zinc plating layer and that extends up to 100 μm from the surface of a base steel sheet, the content of Si is from 0.001% to 0.2% by mass, and an amount of oxide per unit area is 0.05 $g/m^2$ or less.

4. The galvanized steel sheet-manufacturing method according to claim 3, further comprising alloying the steel sheet by heating the steel sheet to a temperature of 450° C. to 550° C. subsequently to galvanizing such that the content of Fe in a plating layer ranges from 7% to 15% by mass.

5. The galvanized steel sheet-manufacturing method according to claim 1, wherein the content of Mn is from 0.1% to 3.0% by mass.

6. The galvanized steel sheet-manufacturing method according to claim 1, wherein a content of C is from 0.01% to 0.15% by mass, a content of Al is from 0.001% to 1.0% by mass, a content of P is from 0.005% to 0.060% by mass, and a content of S is less than 0.01% by mass.

7. The galvanized steel sheet-manufacturing method according to claim 3, wherein a content of C is from 0.01% to 0.15% by mass, a content of Al is from 0.001% to 1.0% by mass, a content of P is from 0.005% to 0.060% by mass, and a content of S is less than 0.01% by mass.

8. The galvanized steel sheet-manufacturing method according to claim 1, wherein $Po_2$ is calculated from:

$$Po_2=(PH_2O/PH_2)^2 x \exp(\Delta G/RT)$$

where $PH_2O$ is a partial pressure of $H_2O$, $PH_2$ is a partial pressure of $H_2$, ΔG is the Gibbs free energy, R is the gas constant and T is the temperature.

9. The galvanized steel sheet-manufacturing method according to claim 3, wherein $Po_2$ is calculated from:

$$Po_2=(PH_2O/PH_2)^2 x \exp(\Delta G/RT)$$

where $PH_2O$ is a partial pressure of $H_2O$, $PH_2$ is a partial pressure of $H_2$, ΔG is the Gibbs free energy, R is the gas constant and T is the temperature.

10. A method for manufacturing a galvanized steel sheet, comprising:

annealing and galvanizing a steel sheet in a continuous galvanizing line, wherein the steel sheet is galvanized such that the partial pressure ($Po_2$) of oxygen in the atmosphere of an all-radiant tube annealing furnace satisfies the following inequality at a temperature of 500° C. to 900° C.:

$$\text{Log } Po_2 \leq -14-0.7\times[Si]-0.3\times[Mn] \quad (1)$$

where [Si] represents a content in mass percent of Si in steel, [Mn] represents a content in mass percent of Mn in steel, and $Po_2$ represents a partial pressure (Pa) of oxygen, the steel sheet contains a zinc plating layer, and an oxide of at least one selected from the group consisting of Fe, Si, Mn, Al, P, B, Nb, Ti, Cr, Mo, Cu, and Ni is present in a surface portion of the steel sheet that lies directly under the zinc plating layer and that extends up to 100 μm from a surface of the steel sheet, the content of Si is from 0.001% to 0.2% by mass, and an amount of the oxide per unit area is 0.05 $g/m^2$ to 0.0001 $g/m^2$.

* * * * *